US005402894A

United States Patent [19]

Winterhoff

[11] Patent Number: 5,402,894

[45] Date of Patent: Apr. 4, 1995

[54] COAL CONDITIONING PROCESS

[75] Inventor: Mary A. Winterhoff, Lockport, Ill.

[73] Assignee: Chemical Dewatering Technology, Inc., Lockport, Ill.

[21] Appl. No.: 138,409

[22] Filed: Oct. 18, 1993

[51] Int. Cl.[6] ..... B03D 1/008; B03D 1/02; B03D 1/10

[52] U.S. Cl. ..... 209/166; 209/167; 210/702; 210/708; 210/709; 210/770; 210/772; 210/778

[58] Field of Search ..... 210/728, 729, 778, 702, 210/770, 772; 209/5, 166, 167

[56] References Cited

U.S. PATENT DOCUMENTS

| | | |
|---|---|---|
| 1,944,529 | 1/1934 | Schafer . |
| 4,162,966 | 7/1979 | Finch . |
| 4,211,642 | 7/1980 | Petrovich . |
| 4,253,944 | 3/1981 | Hefner . |
| 4,278,533 | 7/1981 | Hefner . |
| 4,305,815 | 12/1981 | Hefner . |
| 4,474,619 | 10/1984 | Meyer . |
| 4,537,599 | 8/1985 | Greenwald . |
| 4,604,099 | 8/1986 | Berendt . |
| 4,732,669 | 3/1988 | Nimerick . |

FOREIGN PATENT DOCUMENTS

| | | |
|---|---|---|
| 20275 | 12/1980 | European Pat. Off. . |
| 159285 | 2/1921 | United Kingdom . |
| 272301 | 6/1927 | United Kingdom . |
| 2163975 | 3/1986 | United Kingdom . |

OTHER PUBLICATIONS

Brookstein et al "Foam Assisted Dewatering" Albany Int'nl Research Co. Dedham, Mass.

*Primary Examiner*—Thomas M. Lithgow
*Attorney, Agent, or Firm*—Cherskov & Flaynik

[57] ABSTRACT

A process for improving the efficiency of coal dewatering and deashing uses complexing agents such as sodium gluconate in alkaline solution to form soluble compounds with cations such as $Al^{+3}$, $Fe^{+3}$, $Mg^{+2}$, and $Ca^{+2}$. The formation of such compounds reduces the adsorption and/or desorbs clay slimes from the coal surface.

6 Claims, No Drawings

COAL CONDITIONING PROCESS

BACKGROUND OF THE INVENTION

I. Field of the Invention

Many commercially important coal measures contain substantial proportions of ash. Almost all uses of coal can be accomplished more efficiently by reducing the moisture and ash content of the coal. Especially where the coal is used for generation of heat or electrical power, the moisture content should be reduced to the lowest practical level, and the higher heating value should be as high as possible. Reductions in moisture and ash content produce corresponding increases in the higher heating value of the coal.

My invention relates to a novel chemical coal conditioning process which uses complexing agents such as sodium gluconate in alkaline solution to form soluble compounds with cations such as $Al^{+3}$, $Fe^{+3}$, $Mg^{+2}$, and $Ca^{+2}$. I have found that the formation of such compounds reduces the adsorption and/or desorbs clay slimes from the coal surface. In a preferred embodiment of my invention, deashing and dewatering is further enhanced by addition of surfactants such as those disclosed in my co-pending application, Ser. No. 8-047787 filed Apr. 15, 1993, the disclosure of which is incorporated herein by reference.

II. Description of the Prior Art

Some information is available concerning the chemistry of clay/coal interaction. In Burdon, R. G.; Booth, R. W. and Mishra, S. K., "Factors Influencing the Selection of Process for the Benificiation of Fine Coal", Proceedings of the 7th International Coal Preparation Congress, Sydney, N.S.W., Australia, Paper E.1 (1976), for example, a theoretical discussion of the mechanisms of clay adsorption on the organic constituents of coal is presented, and it is hypothesized that $Fe^{+3}$ and $Al^{+3}$ cations play a role in promoting such adsorption. Eamer, B. J., "Surface Chemical Treatment of Fine Coal With Slime Problem", M. P. Appl. Sc. Thesis, Western Australian Institute of Technology (1981) and Mishra, S. K. and Eamer, B. T., "Effect of Clay Slimes On Flotation Behavior of Coal", Paper presented at the Fine Particle Society Conference (1985) include similar discussions.

Conventional dewatering and deashing processes may use a rotary drum vacuum filter or comparable device to remove ash and water from slurries of fine coal. A variety of chemical pretreatments have been disclosed to improve the performance of these process steps. U.S. Pat. No. 5,192,338 (Waugh), for example, discloses a treating process using serial treatment with aqueous solutions of citric acid and glycerol at elevated temperature for a period of 30 to 45 minutes to beneficiate coal. Mention is made of the use of "organic complexing agents capable of complexing with metal cations" (col. 3, lines 38–39 and 51–56), but the only reagents disclosed in that category are ethylene diamine tetraacetic acid and its disodium salt; 8-hydroxyquinoline and mercaptoethanol.

U.S. Pat. No. 5,089,142 discloses using sodium hexametaphosphate to control slime formation in centrifugal dewatering processes.

Some investigators, as in U.S. Pat. No. 4,231,868 (Wang, et. al.), have suggested adding sulfosuccinate surfactants to slurries of fine coal in order to improve dewatering efficiency. A similar approach was suggested in U.S. Pat. No. 4,985,162 (Cole). Other researchers also have suggested using sulfur and nitrogen-based compounds, as in U.S. Pat. No. 4,897,201 (Yamomoto, et. al.). The introduction of sulfur-containing surfactants into the coal/water slurry, however, requires application rates substantially higher than those used in my invention. Such surfactants also cause undesirable foam formation downstream of the filtration operation that interferes with subsequent coal processing. Therefore, additional anti-foaming agents may be required. The addition of sulfur to the processed coal is also undesirable from an air pollution standpoint.

Still other investigators have suggested the addition of other reagents to the coal/water slurry. A quaternary amine surfactant was suggested in U.S. Pat. No. 4,892,663 (Keys). U.S. Pat. No. 4,290,897 discloses the addition of organopolysiloxanes and U.S. Pat. No. 4,447,344 (Roe) discloses a variety of ethoxylated alcohols.

None of these references, alone or in combination, suggests that the effectiveness of the coal cleaning processes can be improved by using any complexing agents in basic solution, or by following such treatment with the addition of surfactants such as sodium laureth-13 carboxylate salt in aqueous solution in the form of a foam.

SUMMARY OF THE INVENTION

Improving the effectiveness of specific gravity separation of clay slimes from coal appears to depend upon reducing or preventing the adsorption of the clay slimes onto the organic matrix of the coal itself, and/or desorbing the clay slimes from the coal surface. I have found that the extent to which clay slimes adsorb onto the coal particles can be reduced and/or desorbed by treatment with certain complexing agents; most preferably, with sodium gluconate at low concentration in basic solution. Such pretreatment can be followed advantageously with the addition of a foam made from aqueous solutions of surfactants, preferably sodium laureth 13 carboxylate, to the filter cake which is formed during a subsequent dewatering operation. The combination has been found to provide more effective deashing and dewatering than is obtainable by the use of either an organic complexing agent alone, or by means of a surfactant alone.

Accordingly, one object of my invention is to provide a coal dewatering and deashing process that uses sodium gluconate or related molecules in a basic solution substantially at room temperature to react with various cations, forming water-soluble complexes that prevent the adsorption and/or desorb clay slimes from the organic coal matrix, thereby improving the efficiency of the coal cleaning process.

Another object of my invention is to provide a coal dewatering and deashing process that avoids the use of sulfur-containing surfactants by applying a foamed chemical dewatering agent such as sodium laureth-13 carboxylate salt directly to the permeable cake following pretreatment with a complexing agent in a basic solution, to achieve significant ash and moisture content reductions.

DETAILED DESCRIPTION OF THE INVENTION

In the process of my invention, coal is washed in a conventional coal washing facility, which typically segregates the coal based on particle size. Fine coals are separated from coarse coals and continue through the washing process. Fine coal of −28 mesh typically is further washed using a froth flotation step followed by vacuum filtration of the overhead from the froth filtration operation.

My improvements comprise: (1) the addition to the wash water of a basic (alkaline) aqueous solution of a complexing agent capable of complexing with the cations that are naturally present; and (2) the application to the surface of a permeable cake of a dewatering foam made from aqueous solutions of carboxylic acid or carboxylate salts according to the process of my copending application Ser. No. 8-047787 filed Apr. 15, 1993, the disclosure of which is incorporated herein by reference. Complexing agent addition alone improves the results of conventional deashing and dewatering operations; still further improvement is obtained by complexing agent addition followed by the use of a dewatering foam.

More specifically, I have found that the following complexing agents can be used to improve the efficiency of dewatering, ash removal and increase the yield of clean coal: gluconic acid, glucaric acid, gulonic acid, glucoheptonic acid and glucuronic acid as well as their sodium and potassium salt forms. It should be understood that other additional reagents could be added to promote the deashing of the coal. Such other promoter reagents include: ethylene diamine tetraacetic acid (EDTA), pyrophosphate, hexameta phosphate, hydroxy ethylidene diphosphonic acid, amino methylene tri phosphonic acid, phosphonobutane tricarboxylic acid, hexa methylene diamine tetra phosphonic acid, polyacrylic acids, polymethacrylate, acrylate-acrylamide copolymer and maleic anhydride copolymer.

The concentration of complexing agent following its addition to the wash water should be between about 50 and 5000 lbs of active complexing agent per one million lbs of wash water. The most preferred complexing agent concentration corresponds to a loading of approximately 500 lbs of active complexing agent per one million lbs of wash water. The amount of complexing agent required depends upon the specific complexing agent used the coal chemistry, the hardness of the wash water, and the solution pH. However, the specific application can be optimized by using simple laboratory testing procedures.

At the time the complexing agent is added, the pH of the wash water should be adjusted to between about 7.0 and 12.0, and most preferably about 9.0 by addition of suitable bases (e.g., NaOH or KOH).

The complexing reactions will be sufficiently complete within about 5 minutes from the time the coal contacts the wash water. Reaction times can be further shortened by altering concentration and/or pH.

In the preferred embodiment of my invention, the next processing step is continued washing and separation of coal particles based on particle size. Finer particles (minus ¼ inch) are separated from coarse particles for further processing and/or dewatering. Typically, coal particles ranging in size from minus ¼ inch to plus 28 mesh are next dewatered using modified screen bowl centrifuges. The minus 28 mesh coal is further washed using a froth flotation cell. The froth removed from the top of the froth flotation cell is then dewatered via rotary drum vacuum filtration. The effectiveness of dewatering using centrifugal dryers and rotary vacuum systems can be enhanced by using the dewatering foam technique described in my copending application Ser. No. 8-047787 filed Apr. 15, 1993. Any of the dewatering foams disclosed in that application can be used in the process of this invention following the complexing and froth flotation steps.

Laboratory tests were performed to determine quantitatively the performance of certain specific embodiments of my invention. The examples are solely illustrative and do not restrict the scope of my invention.

EXAMPLE 1

About 2750 ml. of aqueous solution containing approximately 1000 ppm of 50 wt % gluconic acid was prepared. Its pH was raised to about 9.0 by adding NaOH. Approximately 250 grams of −28 mesh bituminous Elkhorn no. 2 coal was added. The slurry was mixed and aerated for 5 minutes. The duration of the mixing was selected to duplicate the residence time associated with actual froth flotation cell used at coal processing facilities. After 5 minutes, about 2 ml. of kerosene was added to the slurry and the froth was removed using a collection header attached to a vacuum system. The collected froth was dewatered using a standard vacuum filtration system.

A blank was run under the foregoing conditions without gluconic acid. The results of these test were:

| | % ash dry basis |
|---|---|
| Blank | 9.36 |
| Treated | 6.34 |

Thus, the washed coal that was exposed to gluconic acid treatment had about 56% less ash.

EXAMPLE 2

Two blanks and a treated sample were prepared using the procedure of Example 1. Residue from the bottom was collected and analyzed for ash content. The results were:

| | % ash dry basis |
|---|---|
| Blank 1 | 24.86 |
| Treated | 35.54 |
| Blank 2 | 25.71 |

The increased ash content of the residue further demonstrates that more of the organic matrix of the coal was liberated from the ash, thereby decreasing the ash content and increasing the yield of the washed coal.

EXAMPLE 3

A blank and a treated sample were prepared as described in Example 1. The collected coal removed as froth was then dewatered using a Buchner funnel system controlled at a 15" Hg vacuum for 1 minute. Approximately 0.45 lbs of foamed dewatering agent (specifically, sodium laureth 13 carboxylate) per ton of dry coal was applied as a foam at a 10:1 expansion ratio to both the blank and the gluconic acid-treated sample using the process described in my copending application Ser. No. 8-047787. The results were:

| | % moisture |
|---|---|
| Blank | 35.3 |
| Blank with dewatering foam | 30.1 |

-continued

| | % moisture |
|---|---|
| Treated sample | 32.5 |
| Treated sample with dewatering foam | 18.6 |

Thus, the addition of pretreatment with gluconic acid complexing agent to the process of my copending application Serial No. 8-047787 produces a further 43% improvement in dewatering efficiency.

It will be apparent to those of ordinary skill in the art that changes and modifications could be made while remaining within the scope of my invention. For example, other foamed dewatering agents could be used, as disclosed in my copending application Ser. No. 9-047787 It is my intention, therefore, to cover all such equivalent processes, and to limit my invention only as specifically set forth in the following claims.

I claim:

1. A process for conditioning coal that contains an undesirable clay mineral prior to dewatering and deashing, comprising:
(a) preparing a slurry of wash water and coal;
(b) adding to said slurry a basic aqueous solution of a complexing agent capable of reacting with said undesirable clay mineral to form a water soluble complex, wherein said basic solution has a pH of between about 7 and 12, wherein the concentration of said complexing agent in said wash water is between about 50 and 5000 lbs per one million lbs of wash water, and;
(c) allowing sufficient time at ambient temperature for formation of said water soluble complex;
(d) separating coal from said slurry by froth flotation;
(e) forming a filter cake from said separated coal;
(f) drying said filter cake;
(g) applying a dewatering foam to said filter cake during the process of cake drying; and
(h) completing the filtration of said filter cake.

2. A process for conditioning coal that contains an undesirable clay mineral prior to dewatering and deashing, comprising:
(a) preparing a slurry of wash water and coal;
(b) adding to said slurry a basic aqueous solution of a complexing agent capable of reacting with said undesirable clay mineral to form a water soluble complex, wherein said basic solution has a pH of between about 7 and 12, wherein the concentration of said complexing agent in said wash water is between about 50 to 5000 lbs per one million lbs of wash water, and;
(c) allowing sufficient time at ambient temperature for formation of said water soluble complex;
(d) separating coal from said slurry by froth flotation;
(e) forming a filter cake from said separated coal;
(f) drying said filter cake;
(g) applying a dewatering foam to said filter cake during the process of cake drying; and
(h) completing the filtration of said filter cake.

3. A process for conditioning coal that contains an undesirable clay mineral prior to dewatering and deashing, comprising:
(a) preparing a slurry of wash water and coal;
(b) adding to said slurry a basic aqueous solution of a complexing agent capable of reacting with said undesirable clay mineral to form a water soluble complex, wherein said basic solution has a pH of between about 7 and 12, wherein the concentration of said complexing agent in said wash water is between about 50 to 5000 lbs per one million lbs of wash water, and;
(c) allowing sufficient time at ambient temperature for formation of said water soluble complex;
(d) separating coal from said slurry by froth flotation;
(e) forming a filter cake from said separated coal;
(f) drying said filter cake;
(g) applying a dewatering foam to said filter cake during the process of cake drying; and
(h) completing the filtration of said filter cake.

4. A process for conditioning coal that contains an undesirable clay mineral prior to dewatering and deashing, comprising:
(a) preparing a slurry of wash water and coal;
(b) adding to said slurry a basic aqueous solution of a complexing agent capable of reacting with said undesirable clay mineral to form a water soluble complex;
(c) allowing sufficient time at ambient temperature for formation of said water soluble complex;
(d) separating coal from said slurry by froth flotation;
(e) forming a filter cake from said separated coal;
(f) drying said filter cake;
(g) applying a dewatering foam to said filter cake during the process of cake drying, where said dewatering foam is made from an aqueous solution of a dewatering agent and contains between about 0.1 wt % dewatering agent and about 1.0 wt % of said dewatering agent, wherein said dewatering agent is sodium laureth-13 carboxylate; and
(h) completing filtration of said filter cake.

5. A process for conditioning coal that contains an undesirable clay mineral prior to dewatering and deashing, comprising:
(a) preparing a slurry of wash water and coal;
(b) adding to said slurry a basic aqueous solution of a complexing agent capable to reacting with said undesirable clay mineral to form a water soluble complex, wherein the pH of said basic solution is between about 7 and 12, the concentration of said complexing agent in said wash water is between about 50 to 5000 lbs of active complexing agent per one million lbs of wash water; and wherein said complexing agent is gluconic acid;
(c) allowing sufficient time at ambient temperature for formation of said water soluble complex;
(d) separating coal from said slurry by froth flotation; and
(e) dewatering said coal through the use of a dewatering foam wherein the step of dewatering said coal through the use of a dewatering foam comprises
(f) forming a filter cake from said separated coal;
(g) drying said filter cake;
(h) applying a dewatering foam to said filter cake during the process of cake drying, where said dewatering foam is made from an aqueous solution of a dewatering agent and contains between about 0.1 wt % dewatering agent and about 1.0 wt % of said dewatering agent; and
(i) completing filtration of said filter cake.

6. A process for conditioning coal that contains an undesirable clay mineral prior to dewatering and deashing, comprising:
(a) preparing a slurry of wash water and coal;
(b) adding to said slurry a basic aqueous solution of a complexing agent capable of reacting with said undesirable clay mineral to form a water soluble complex, wherein the pH of said basic solution if between about 7 and 12, the concentration of said complexing agent in said wash water is between about 50 to 5000 lbs of active complexing agent per one million lbs of wash water; and wherein said complexing agent is gluconic acid;

(c) allowing sufficient time at ambient temperature for formation of said water soluble complex;

(d) separating coal from said slurry by froth flotation; and (e) forming a filter cake from said separated coal;

(f) drying said filter cake;

(g) applying a dewatering foam to said filter cake during the process of cake drying, wherein said dewatering foam is made from an aqueous solution of a dewatering agent and contains between about 0.1 wt % dewatering agent and about 1.0 wt % of said dewatering agent; wherein said dewatering agent is sodium laureth-13 carboxylate and (h) completing filtration of said filter cake.

* * * * *

UNITED STATES PATENT AND TRADEMARK OFFICE

CERTIFICATE OF CORRECTION

PATENT NO. : 5,402,894

DATED : April 4, 1995

INVENTOR(S) : Mary Anne Winterhoff

It is certified that error appears in the above-indentified patent and that said Letters Patent is hereby corrected as shown below:

On title page, item [75] Inventor:

delete middle initial "A." and insert --Anne--.

Column 5, line 31, after the word "and", insert --wherein said complexing agent is selected from the group consisting of gluconic acid, glucaric acid, gulonic acid, glucoheptonic acid and glucuronic acid--;

line 51, after the word "and", insert --wherein said complexing agent is selected from the group consisting of the sodium salts of gluconic acid, glucaric acid, gulonic acid, glucoheptonic acid and glucuronic acid--.

Column 6, line 3, after the word "and", insert --wherein said complexing agent is selected from the group consisting of the potassium salts of gluconic acid, glucaric acid, gulonic acid, glucoheptonic acid and glucuronic acid--.

Signed and Sealed this

Twenty-seventh Day of June, 1995

*Attest:*

Bruce Lehman

BRUCE LEHMAN

*Attesting Officer*

*Commissioner of Patents and Trademarks*